US008290401B2

(12) United States Patent
Tsutsumi

(10) Patent No.: US 8,290,401 B2
(45) Date of Patent: Oct. 16, 2012

(54) IMAGE FORMING APPARATUS HAVING CHARGE ELIMINATOR

(75) Inventor: Masahiro Tsutsumi, Osaka (JP)

(73) Assignee: Kyocera Mita Corporation (JP)

( * ) Notice: Subject to any disclaimer, the term of this patent is extended or adjusted under 35 U.S.C. 154(b) by 346 days.

(21) Appl. No.: 12/834,044

(22) Filed: Jul. 12, 2010

(65) Prior Publication Data

US 2011/0020034 A1 Jan. 27, 2011

(30) Foreign Application Priority Data

Jul. 21, 2009 (JP) ..... 2009-169841
Nov. 18, 2009 (JP) ..... 2009-263337

(51) Int. Cl.
*G03G 21/06* (2006.01)

(52) U.S. Cl. ..... 399/128; 399/186

(58) Field of Classification Search ..... 399/127, 399/128, 186, 187
See application file for complete search history.

(56) References Cited

U.S. PATENT DOCUMENTS 7,395,010 B2 * 7/2008 Miyaji ..... 399/128
7,421,229 B2 * 9/2008 Tomiie et al. ..... 399/128

FOREIGN PATENT DOCUMENTS

JP 2006-234882 9/2006

* cited by examiner

*Primary Examiner* — Hoang Ngo
(74) *Attorney, Agent, or Firm* — Gerald E. Hespos; Michael J. Porco

(57) ABSTRACT

An image forming apparatus includes an image carrying body having a surface on which a toner image is formed. A charger charges the surface body and a charge eliminator removes charge from the surface. The charge eliminator includes light sources to generate charge elimination light and a light guide to guide the charge elimination light onto the surface. The light guide includes a first portion to guide the charge elimination light onto an axial central portion of the image carrying body and a second portion to guide the charge elimination light onto axial end portions of the image carrying body. The second light guide portion allows charge elimination light that is incident on the first light guide portion to travel into the second light guide portion, but restricts charge elimination light that is incident on the second light guide portion from traveling into the first light guide portion.

10 Claims, 8 Drawing Sheets

IMAGE FORMING APPARATUS HAVING CHARGE ELIMINATOR

BACKGROUND OF THE INVENTION

1. Field of the Invention

The present invention relates to an image forming apparatus including a charge eliminator which removes charge from the surface of a photosensitive drum.

2. Description of the Background Art

An electrophotographic type of image forming apparatus, such as a printer or copying machine, generally includes a photosensitive drum, a charger which uniformly charges the surface of the photosensitive drum, an exposure device which forms an electrostatic latent image on the surface by exposing the surface, a developer which forms a toner image by supplying toner to the electrostatic latent image, a cleaner which removes residual toner remaining on the surface of the photosensitive drum after transferring the toner image to a transfer material, and a charge eliminator which removes electrical charge remaining on the surface of the photosensitive drum.

Charge eliminators generally use a light-based charge elimination method based on a LED (Light Emitting Diode). However, in a charge eliminator which employs a point light source such as a LED, there is a problem in that non-uniformity in luminosity is liable to occur when charge elimination light is irradiated onto the photosensitive drum. In particular, there is a tendency for the amount of light to decline in the end portions in the axial direction of the photosensitive drum. Therefore, countermeasures are adopted such as raising the arrangement density of the LED in the end portions of the axial direction, increasing the length of the charge eliminator in the axial direction to greater than the necessary length, and suppressing decline in the amount of liquid in the end portions of the axial direction of the photosensitive drum.

However, if the arrangement density of the LEDs is raised, then costs rise with the increase in the number of the LEDs arranged, and the temperature is liable to rise. Furthermore, if the charge eliminator is increased in length, there is a problem in that the charge eliminator occupies more space than necessary, thus impeding compactification of the image forming apparatus.

Consequently, a conventional image forming apparatus uses a method according to which the irradiation width from the emission end of the light guide member of the charge eliminating apparatus until the photosensitive drum is set to be longer in the end portions in the axial direction compared to the central portion in the axial direction, and the irradiation time of the charge elimination light in the end portions in the axial direction is set to be longer than the central portion in the axial direction. Since the total amount of charge elimination light increases, the longer the irradiation time of the charge elimination light, it is possible to prevent decline in the amount of light at either end in the axial direction.

However, with this method, since the irradiation time is made longer, then it is necessary to set a broader charge elimination light irradiation range than normal, in the end portions in the axial direction. The need to increase the irradiation range in this way may restrict the freedom of the arrangement positions of the other devices, and consequently impedes compactification of the image forming apparatus.

SUMMARY OF THE INVENTION

An object of the present invention is to provide an image forming apparatus that the charger elimination light irradiation range on the surface of an image carrying body can be made substantially uniform in the central portion of the axial direction and the end portions of the axial direction.

The image forming apparatus relating to one aspect of the present invention which achieves this object is an image forming apparatus including: an image carrying body which has a surface on which a toner image is formed, and rotates about an axis; a charger which charges the surface of the image carrying body in order to form the toner image; and a charge eliminator which removes charge from the surface of the image carrying body after the toner image is transferred from the image carrying body to a transfer material; wherein the charge eliminator includes: a plurality of light sources which are arranged in an axial direction of the image carrying body, and generate charge elimination light; a light guide member which is disposed between the plurality of light sources and the surface, and guides the charge elimination light onto the surface; the light guide member has a first light guide portion which guides the charge elimination light onto a central portion of the image carrying body in the axial direction, and a second light guide portion which guides the charge elimination light respectively onto both end portions of the image carrying body in the axial direction; the plurality of light sources include a first light source which irradiates light onto the first light guide portion and a second light source which irradiates light onto the second light guide portions; and the second light guide portion has a restrictive structure which allows charge elimination light from the first light source that is incident on the first light guide portion to travel into the second light guide portion, but restricts charge elimination light from the second light source that is incident on the second light guide portion from traveling into the first light guide portion.

BRIEF DESCRIPTION OF THE DRAWINGS

FIG. 8A shows a first example of a light guide member according to the third embodiment, and FIG. 8B shows a second example of a light guide member according to the third embodiment.

DETAILED DESCRIPTION OF THE PREFERRED EMBODIMENTS

Figure 1:
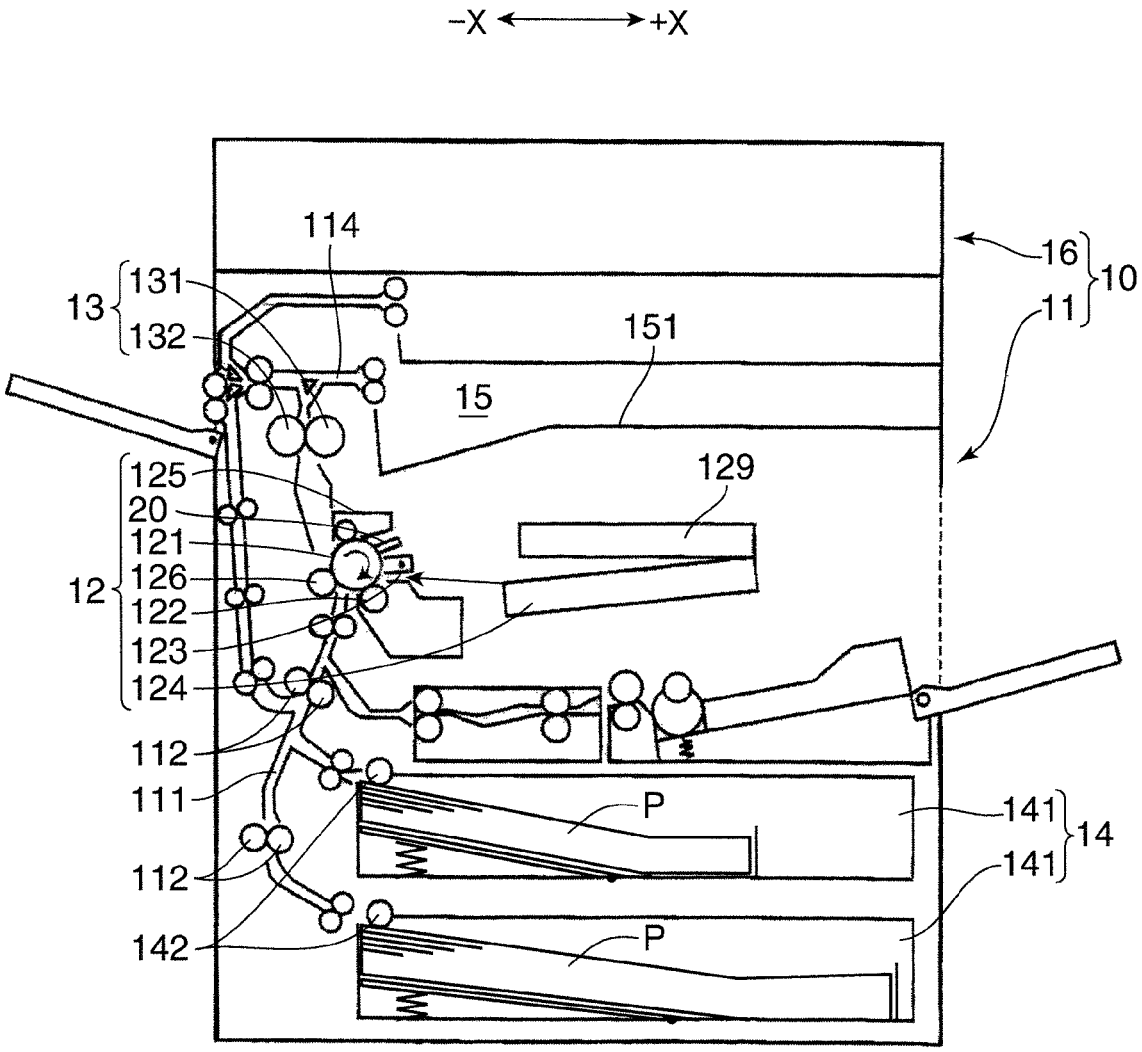
FIG. 1 is a cross-sectional diagram showing an overview of an image forming apparatus relating to one embodiment of the present invention.
Figure 2:
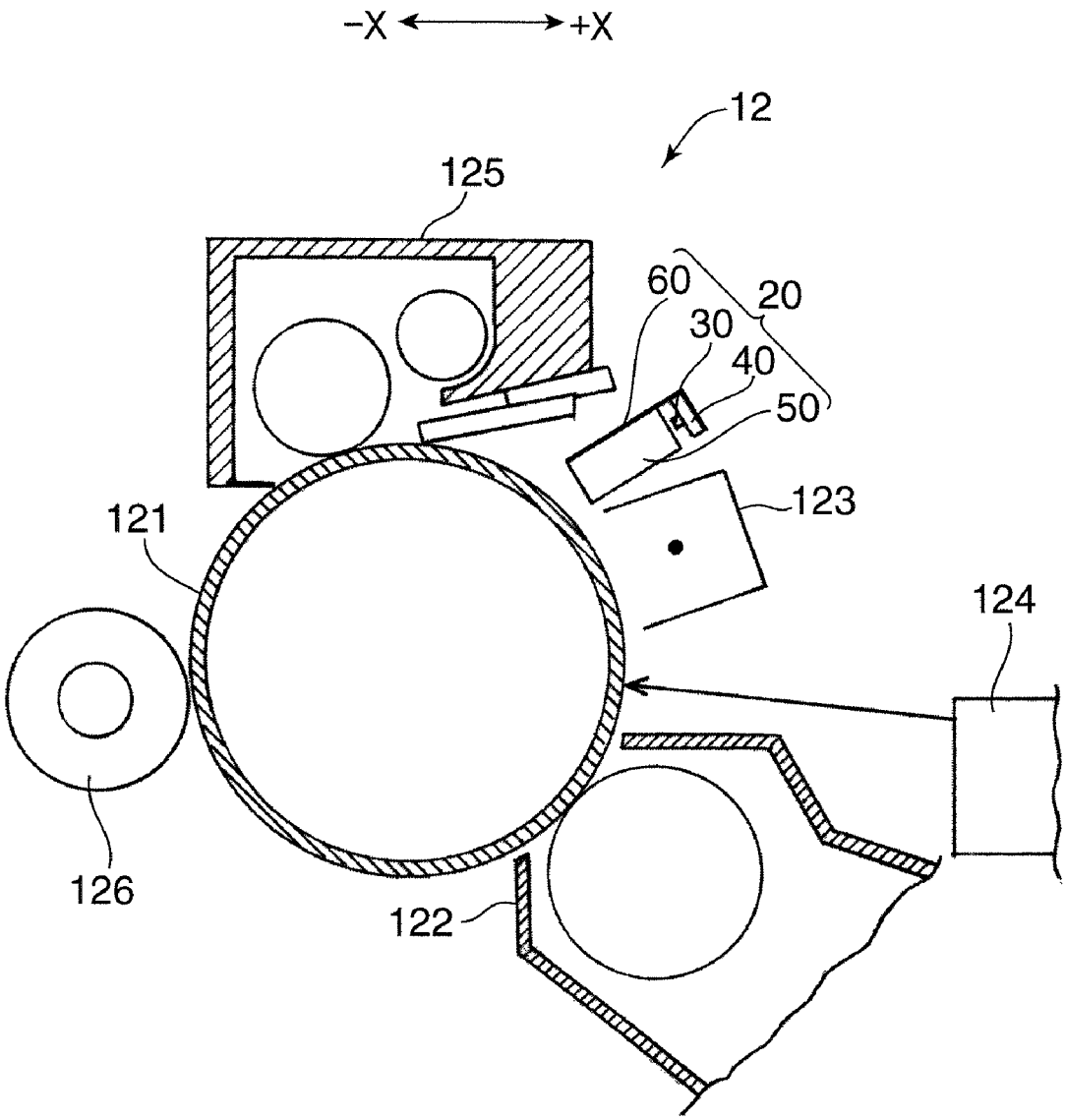
FIG. 2 is an enlarged illustrative diagram of an image forming unit of the image forming apparatus shown in FIG. 1.

Below, an image forming apparatus including a charge eliminator relating to an embodiment of the present invention is described with reference to the drawings. FIG. 1 is a cross-sectional diagram showing an image forming apparatus 10 relating to an embodiment of the present invention and FIG. 2 is an enlarged diagram of an image forming unit 12 of the image forming apparatus 10 in FIG. 1. In FIG. 1 and FIG. 2, the X direction denotes the left/right direction and in particular, −X denotes the leftward direction and +X denotes the rightward direction.

The image forming apparatus 10 is used as a so-called composite machine which has the functions of a copying machine, a printer and a facsimile apparatus, and basically includes an apparatus main body 11 having a box shape known as an internal paper output type, and a image reading unit 16, provided on the upper side of the apparatus main body 11, for reading out the original image.

An image forming unit 12, a fixing unit 13 and a paper storage unit 14 are provided inside the apparatus main body 11. The image forming unit 12 forms an image on the basis of image information for the original document P1 which is read by an optical unit of the image reading unit 16, image information transmitted from an external device, such as a computer, or image information transmitted via a communications network, or the like. The fixing unit 13 carries out a fixing process of the image which has been formed by the image forming unit 12 and transferred onto the paper P. The paper storage unit 14 stores paper P for transfer. A paper discharge unit 15 including an internal paper discharge tray 151 which receives output paper P that has undergone a fixing process, is formed between the top portion of the apparatus main body 11 and the image reading unit 16.

The image reading unit 16 includes an optical unit having a light source in order to read optically an image of an original document. The optical unit irradiates and scans light onto the surface of an original document P1 which is placed on a contact glass (not illustrated) provided in the top portion of the apparatus main body 11, or is supplied onto the contact glass from an automatic original reading apparatus (not illustrated). The light reflected from the original document surface is input to the CCD (Charge Coupled Device), where the reflected light is converted into an analogue signal. This analogue signal is converted to a digital signal by an ND converter and then input to an exposure apparatus 124, which is described hereinafter.

An operating panel (not illustrated) for inputting processing conditions relating to the reading of the original image, copying processes, and the like, is provided in a suitable position on the outer cover of the image reading unit 16. A LCD (Liquid Crystal Display) or the like is provided in this operating panel.

The image forming unit 12 forms a toner image on paper P which has been supplied from the paper storage unit 14, on the basis of the input image information. A photosensitive drum (image carrying body) 121 and a developing apparatus 122 are provided respectively in the image forming unit 12. The photosensitive drum 121 receives a supply of toner from the developing apparatus 122 while rotating in a clockwise direction in FIG. 1. Toner is replenished to the developing apparatus 122 from a toner cartridge 129 which is installed detachably at a suitable position inside the apparatus main body 11.

A charger 123 is provided in a position directly above the developing apparatus 122, to the right-hand side of the photosensitive drum 121, and an exposure apparatus 124 is provided in a position to the right-hand side of the charger 123. The circumferential surface of the photosensitive drum 121 is charged uniformly by the charger 123, and laser light based on the image data read by the image reading unit 16 is irradiated onto the circumferential surface of the charged photosensitive drum 121 from the exposure apparatus 124. By this means, an electrostatic latent image is formed on the circumferential surface of the photosensitive drum 121. By supplying toner to the electrostatic latent image from the developing apparatus 122, a toner image is formed on the circumferential surface of the photosensitive drum 121.

A cleaning apparatus 125 which removes and cleans residual toner on the circumferential surface of the photosensitive drum 121 is provided in a position directly above the photosensitive drum 121. A charge eliminator 20 which removes electrical charge remaining on the circumferential surface of the photosensitive drum 121 after the cleaning process is provided between the cleaning apparatus 125 and the charger 123. The circumferential surface of the photosensitive drum 121 from which charge has been removed by the charge eliminator 20 subsequently faces the charging device 123 in order to undergo a new charging process.

The waste toner that has been removed from the circumferential surface of the photosensitive drum 121 by the cleaning apparatus 125 is recovered into a toner recovery bottle (not illustrated) via a prescribed path.

Figure 3:
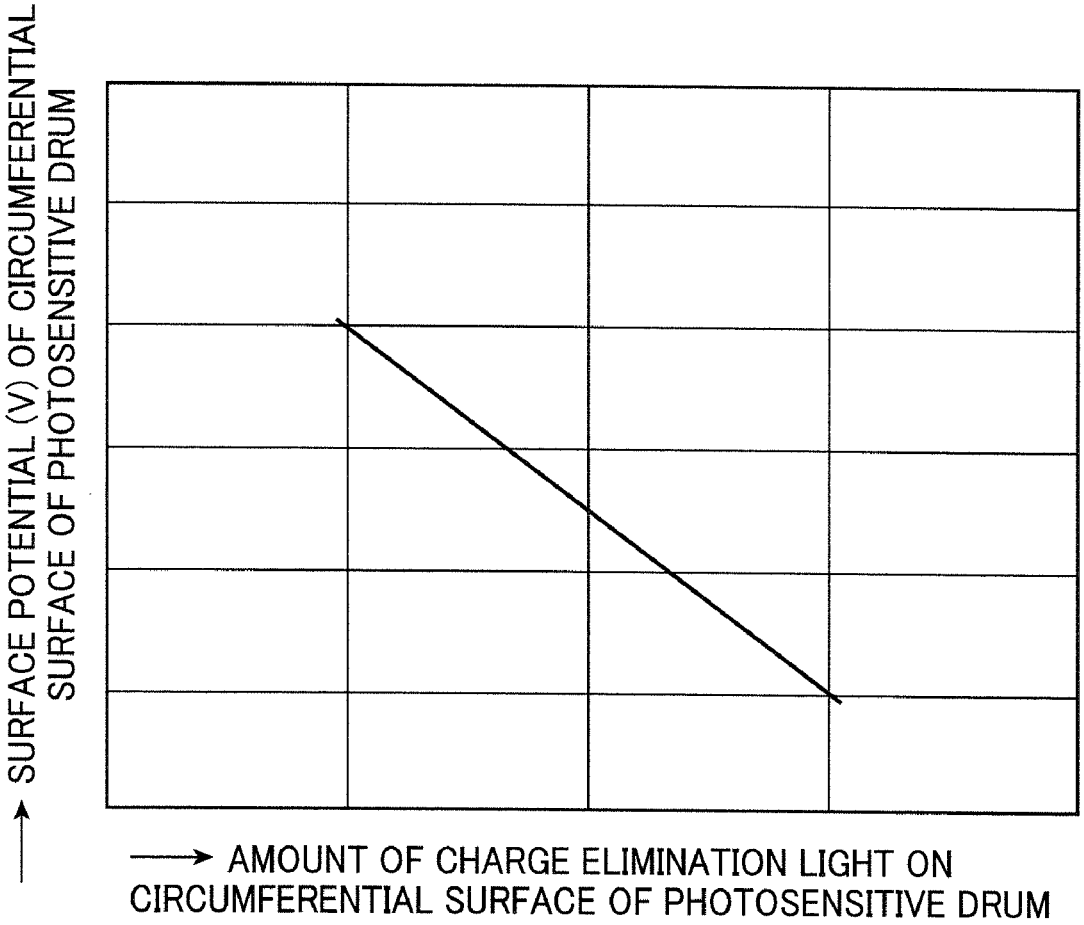
FIG. 3 is a graph showing the relationship between the amount of charge elimination light on the circumferential surface of the photosensitive drum and the surface potential.

Incidentally, FIG. 3 is a graph showing the relationship between the amount of charge elimination light on the circumferential surface of the photosensitive drum and the surface potential. The relationship between the amount of charge elimination light on the circumferential surface of the photosensitive drum and the surface potential which is shown in this graph relates to a case where a photosensitive drum 121 made of an OPC (Organic Photo Conductor) is employed. As shown in this graph, it can be seen that the value of the surface potential on the circumferential surface of the photosensitive drum 121 decreases proportionately with a negative proportional constant with respect to the amount of charge elimination light on the circumferential surface. The amount of charge elimination light irradiated onto the circumferential surface of the photosensitive drum 121 is set on the basis of this relationship.

A paper conveyance path 111 extending in the vertical direction is formed in a position to the left of the image forming unit 12 in FIG. 1. A conveyance roller pair 112 is provided in a suitable position in the paper conveyance path 111. Paper P supplied from the paper storage unit 14 is conveyed to the photosensitive drum 121 by driving the conveyance rollers pair 112.

A transfer roller 126 which abuts against the photosensitive drum 121 is provided at a position opposing the photosensitive drum 121 in the paper conveyance path 111. When the paper P which has been conveyed along the paper conveyance path 111 arrives at the nip section between the transfer roller 126 and the photosensitive drum 121, a toner image on the photosensitive drum 121 is transferred onto the paper P due to being pressurized and gripped in the nip section.

The fixing unit 13 carries out a fixing process on the toner image on the paper P transferred in the image forming unit 12, and includes a fixing roller 131 having an internal electrical heater, which forms a heat source, and a pressurizing roller 132 which is arranged opposing the fixing roller 131 in the left-hand side in FIG. 1.

The paper P onto which the toner image has been transferred is conveyed from the image forming unit 12 via the transfer roller 126 and is supplied to the nip section between the fixing roller 131 and the pressurizing roller 132. By being pressurized and gripped in this nip section and also receiving heat from the fixing roller 131, a process for fixing the toner image onto the paper P is carried out. By this means, the toner image on the paper P is made stable. The paper P which has completed the fixing process is discharged via a paper output conveyance path 113 extending from the upper side of the fixing unit 13, to an in-drum paper discharge tray 151 of the paper discharge unit 15 which is formed between the apparatus main body 11 and the image reading unit 16.

The paper storage unit 14 has a paper tray 141, which is installed detachably at a position below the exposure apparatus 124 in the apparatus main body 11. A stack of paper is stored in the paper tray 141. The paper P is paid out one sheet at a time from the stack of paper stored in the paper tray 141, by driving the pick-up roller 142, and is introduced into the image forming unit 12 via the paper conveyance path 111.

The image forming apparatus 10 relating to the present embodiment includes a manual feed mechanism whereby paper P is supplied manually, a double-side printing mechanism which carries out double-side printing onto the paper P, a printer function for carrying out print processing on the basis of image information transmitted from an external device, such as a computer, and a facsimile function for sending and receiving image information via a communications network, and the like, but these various functions are not described here.

Figure 4:
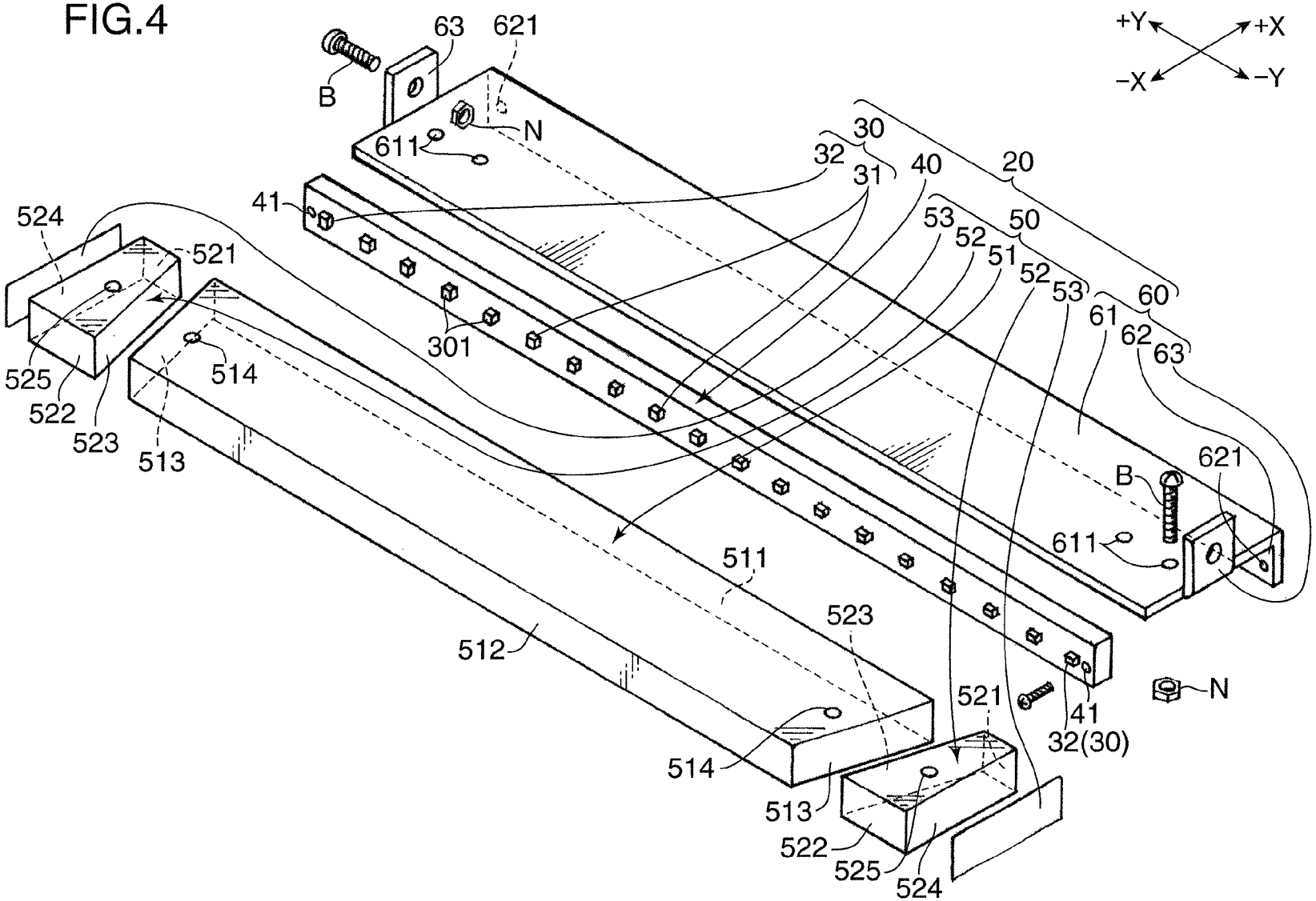
FIG. 4 is an exploded perspective diagram showing a charge eliminator in which a light guide plate according to a first embodiment of the present invention is employed.
Figure 5:
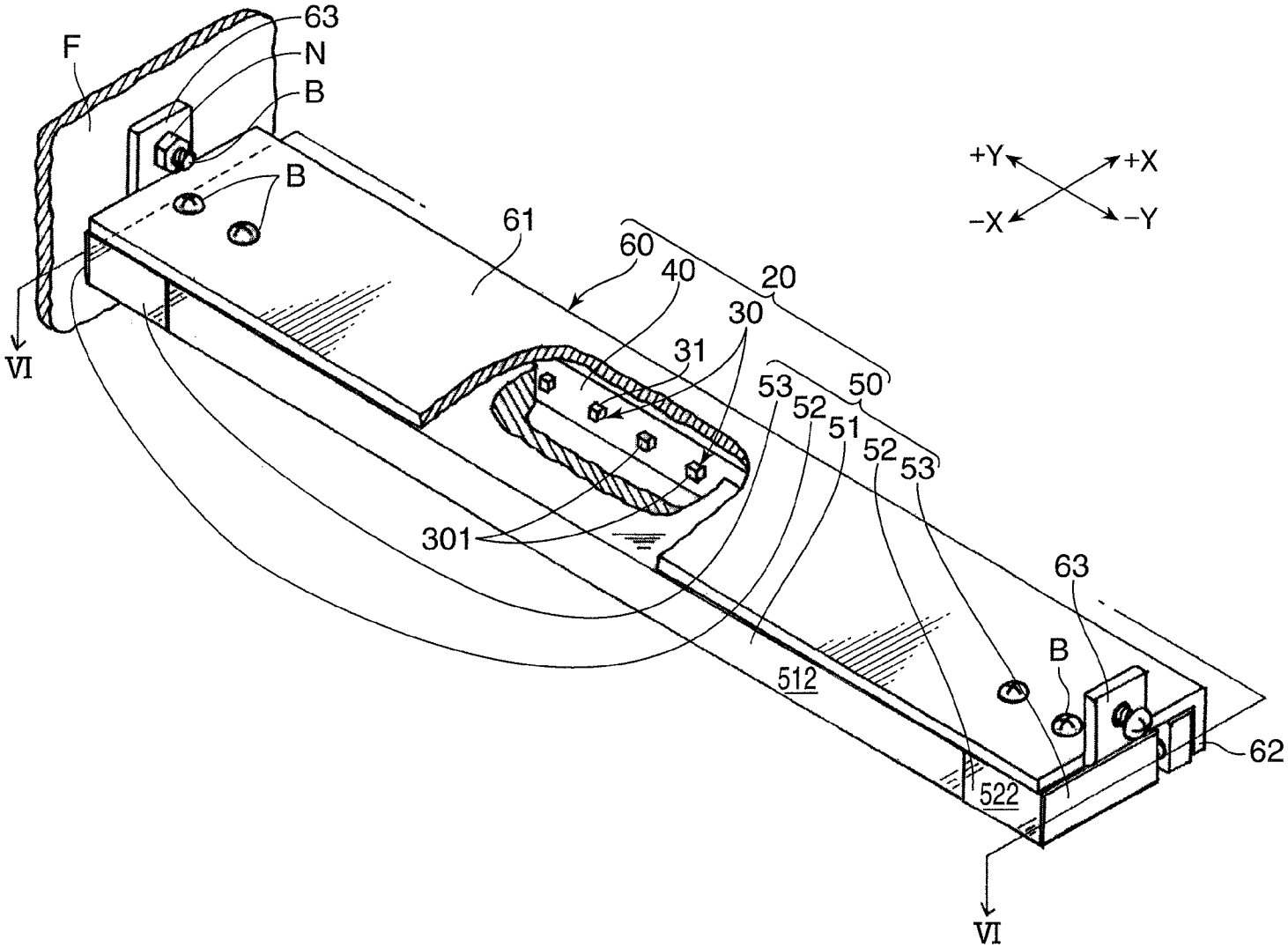
FIG. 5 is an assembly perspective diagram of a charge eliminator according to a first embodiment.

Below, a charge eliminator 20 which employs a light guide member 50 relating to the first embodiment is described on the basis of FIG. 4 and FIG. 5, with reference to other drawings where necessary. FIG. 4 and FIG. 5 are perspective diagrams showing a charge eliminator 20 which employs a light guide member 50 according to the first embodiment; FIG. 4 is an exploded perspective diagram and FIG. 5 is an assembly perspective diagram. The X direction in FIG. 4 and FIG. 5 indicates the left/right direction, and the Y direction indicates the forward/rearward direction. In particular, the −X direction is the leftward direction, the +X direction is the rightward direction, the −Y direction is the forward direction and the +Y direction is the rearward direction.

The charge eliminator 20 is constituted by a plurality of LED (light sources) 30 which are arranged in parallel at a uniform pitch, an LED substrate 40 which is long in the front/rear direction and holds the plurality of LEDs 30, and a light guide member 50 which guides the light from the plurality of LEDs 30, these elements being held by a holder 60.

Each of the LEDs 30 has a small rectangular parallelepiped shape and a light-emitting surface 301 on one side thereof. A plurality of the LEDs 30 are arranged in parallel at a uniform pitch in the front/rear direction on the left-hand surface side of the LED substrate 40, with the respective light-emitting surfaces 301 facing toward the light guide member 50 on the left-hand side. Of the plurality of LEDs 30 (19 LEDs are depicted in the examples shown in FIG. 4 and FIG. 6), the 17 LEDs in the central portion excluding the LEDs situated at either end are central portion LEDs (first light sources) 31, and the two LEDs at either end are endmost portion LEDs (second light sources) 32.

The length dimension of the LED substrate 40 is set to be slightly shorter than the internal front/rear dimension of the apparatus main body 11 of the image forming apparatus 10, and is thereby set to a dimension which can correspond to the whole length of the axial direction of the photosensitive drum 121. Threaded screw holes 41 penetrating in the left/right direction are formed respectively in the front and rear end portions of the LED substrate 40. The LED substrate 40 is fixed to the holder 60 by threading and fastening bolts B respectively into the screw holes 41.

The light guide member 50 transmits the light emitted from the LEDs 30 and irradiates the light onto the circumferential surface of the photosensitive drum 121. The light guide member 50 includes a first light guide plate (first light guide portion) 51 which is long in the front/rear direction and has a trapezoidal shape in plan view, a front and rear pair of second light guide plates (second light guide portions) 52 provided respectively in a hermetically sealed state on the front and rear edge portions of the first light guide plate 51, and reflective sheets 53 made of synthetic resin which are attached to the front and rear end faces of the respective second light guide plates 52.

The front/rear dimension of the light guide member 50 of this kind when the first and second light guide plates 51, 52 are in a bonded state is set to be substantially the same as the front/rear dimension of the LED substrate 40, and the vertical dimension thereof is set to be substantially the same as the vertical dimension of the LED substrate 40.

In the first light guide plate 51, the opposing edge face (right-hand edge face (incidence face) 511) which opposes the LED substrate 40 is set to a length dimension which does not include the LEDs 30 in the front and rear end portions. On the other hand, the length dimension of the left-hand edge face (emission face) 512 on the opposite side to the right-hand edge face 511 is set to be slightly shorter than the right-hand edge face 511. Therefore, inclined edge faces 513 are formed respectively on the front and rear end faces of the first light guide plate 51. The angles of inclination of the front and rear inclined edge faces 513 with respect to the right-hand end face 511 are set to be equal to one another.

In each of the respective second light guide plates 52, the opposing edge face (right-hand edge face (incidence face) 521) which opposes the LED substrate 40 is set to a length dimension which can only include one LED 30 each in the front and rear end portions. On the other hand, the length dimension of the left-hand edge face (emission face) 522 on the opposite side to the right-hand edge face 521 is set to be slightly longer than the right-hand edge face 521. Inclined edge faces 523 having an equal angle of inclination as the inclined edge faces 513 of the first light guide plate 51 are formed on the surfaces of the front/rear second light guide plates 52 which oppose the first light guide plate 51.

A mirror surface side of a reflective sheet 53 is bonded respectively to the end surface 524 of each of the second light guide plates 52 which oppose the respective inclined edge faces 523. Consequently, the light which has passed through the second light guide plates 52 from the LEDs 30 and has reached the reflective sheet 53 is reflected by the mirror surface of the reflective sheet 53, and therefore never leaks out to the exterior via the inclined edge faces 523.

Installation holes 514 are provided respectively passing in the vertical direction through the front and rear edge sections of the first light guide plate 51. The first light guide plate 51 is fixed to the holder 60 by inserting bolts B into the installation holes 514 and fastening with a nut N. Furthermore, installation holes 525 are pierced respectively passing in the vertical direction through the central portions of the second light guide plates 52. The respective second light guide plates 52 are fixed respectively to the holder 60 by inserting bolts B into the installation holes 525 and fastening with a nut N.

The holder 60 is formed by pressing a metal plate. This holder 60 includes: a holder plate 61 corresponding to the LED substrate 40 and the light guide member 50; a holding plate 62 which is bent downwards from the right-hand edge portion of the holder plate 61; and a front and rear pair of projecting plates 63 which respectively project upwards from the front and rear edge portions of the holder plate 61. The holding plate 62 serves to hold the LED substrate 40.

The left/right width dimension of the holder plate 61 is set to be slightly longer than the combined left/right dimension of the LED substrate 40 and the light guide member 50, and the front/rear dimension of the holder plate 61 is set to be substantially the same as the light guide member 50. Through holes 611 are pierced respectively in the holder plate 61 at positions corresponding to the pair of installation holes 514 of the first light guide plate 51 and positions corresponding to the installation holes 525 of the respective second light guide plates 52.

Threaded screw holes 621 are provided respectively in the holding plate 62 at positions corresponding to the pair of screw holes 41 in the LED substrate 40. An assembly operator passes bolts B through the screw holes 41, in a state where the surface opposite to the surface of the LED substrate 40 on which the LEDs 30 are provided is abutted against the left-hand surface of the holding plate 62, and then screws and fastens the bolts B into the screw holes 621. By this means, the LED substrate 40 is fixed to the holding plate 62 of the holder 60 with the light-emitting faces 301 of the LEDs 30 facing toward the left-hand side.

Moreover, after fixing the LED substrate 40 to the holding plate 62, the assembly operator abuts the respective upper surfaces of the first light guide plate 51 and the pair of second light guide plates 52 against the lower surface of the holder plate 61, and then respectively inserts bolts B via the through holes 611 of the holder plate 61 and into the installation holes 514 of the first light guide plate 51 and the installation holes 525 of the pair of second light guide plates 52, and fastens the bolts by screwing nuts N onto the front ends of the bolts B. By this means, the first and second light guide plates 51 and 52 are fixed to the holder plate 61 of the holder 60.

By fixing the LED substrate 40 and the light guide member 50 to the holder 60 in this way, the charge eliminator 20 is completed as shown in FIG. 5. This charge eliminator 20 is installed at a prescribed position inside the apparatus main body 11 by screw fastening to a prescribed frame F inside the apparatus main body 11 via the projecting plates 63.

The material of the first and second light guide plates 51 and 52 is chosen such that a refractive index of the second light guide plates 52 is greater than a refractive index of the first light guide plate 51. In the present embodiment, polycarbonate is used for the first light guide plate 51 and transparent glass is used for the second light guide plates 52. A restricting structure in the light guide member 50 according to the first embodiment is constituted by the first light guide plate 51 and the second light guide plates 52 which have different refractive indices.

Furthermore, the angle of inclination of the inclined edge face 523 of each second light guide plate 52 with respect to the right-hand edge face 511 is set in such a manner that the total reflection occurs at the inclined edge face 523 about all of the incident light which is incident on the second light guide plate 52 from the endmost LEDs 30 at the front and rear ends and which is reflected by the reflective sheet 53. Consequently, the light irradiated from the front end and rear end LEDs 30 (the endmost portion LEDs 32) of the LED substrate 40 never leaks externally from the front end face and the rear end face of the light guide member 50 where the reflective sheets 53 are respectively attached. Moreover, the light which passes through the interior of the second light guide plates 52 and travels toward the first light guide plate 51 is totally reflected and therefore does not enter into the first light guide plate 51. Consequently, it is possible to prevent the occurrence of problems, such as the loss of capability to carry out an adequate charge eliminating process due to decline in the amount of light in both end portions in the axial direction of the circumferential surface of the photosensitive drum 121.

Figure 6A:
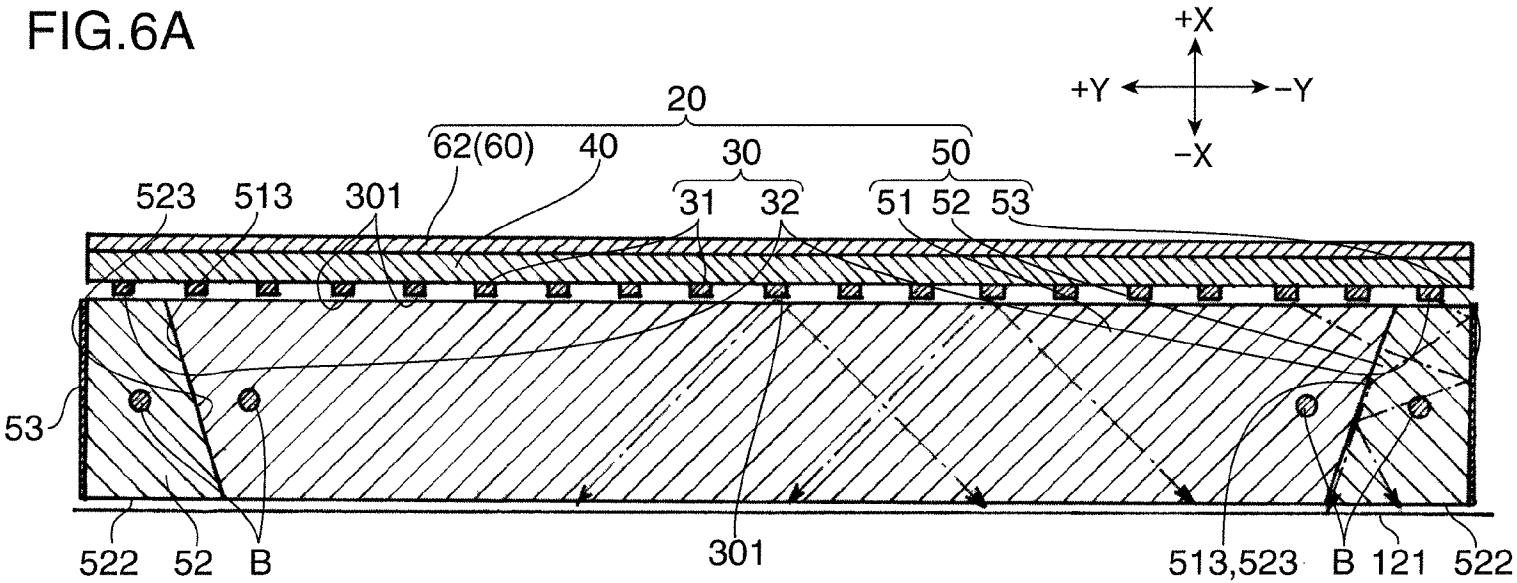
FIG. 6A is a cross-sectional diagram along line VI-VI in FIG. 5.
Figure 6B:
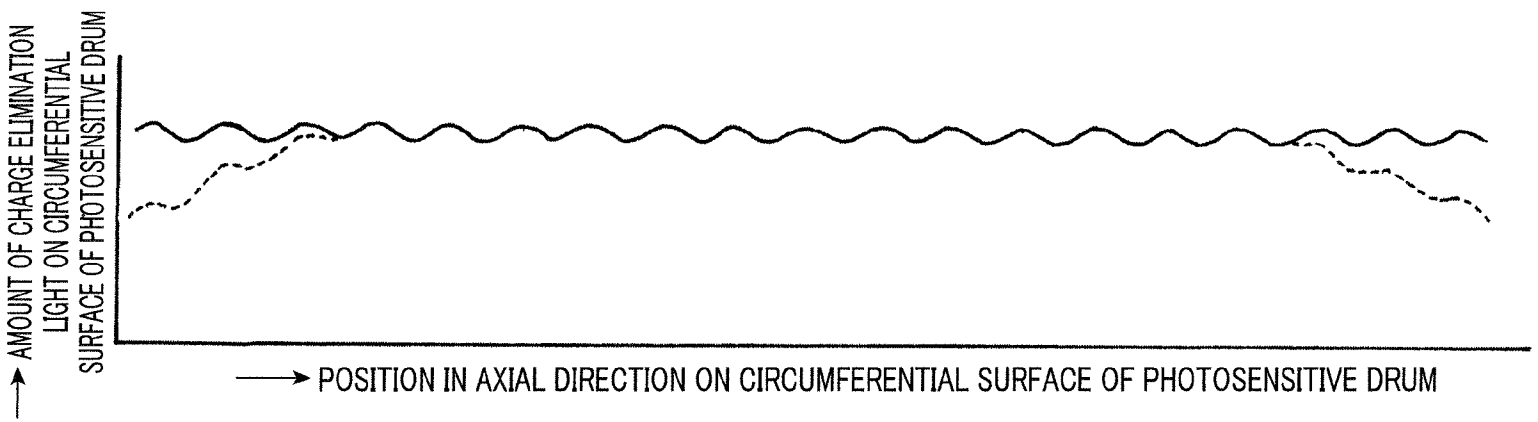
FIG. 6B is a graph showing the distribution of the amount of charge elimination light in this composition.

FIGS. 6A and 6B are diagrams for describing the action of the light guide member 50 according to the first embodiment, wherein FIG. 6A is a cross-sectional diagram along line VI-VI in FIG. 5 and FIG. 6B is a graph showing a relationship between the position in the axial direction of the circumferential surface of the photosensitive drum 121 and the amount of charge elimination light irradiated onto the circumferential surface. The X and Y directions indicated in FIG. 6A are the same as those in FIG. 4 (−X: leftward; +X: rightward; −Y: forward; +Y: rearward).

As shown in FIG. 6A, the charge elimination light emitted from each of the plurality of central portion LEDs 31 (in the example shown in FIG. 6A, there are 17 central portion LEDs 31) provided to correspond to the first light guide plate 51 of the light guide member 50 travels respectively inside the first light guide plate 51 while progressively broadening in a prescribed manner, and therefore the light from the central portion LEDs 31 assumes a mutually overlapping state. Consequently, as shown in FIG. 6B, the distribution of the charge elimination light irradiated onto the circumferential surface of the photosensitive drum 121 is standardized in overall terms, forming a wave (sin curve) of low amplitude in the axial direction of the photosensitive drum 121.

A portion of the charge elimination light emitted from the central portion LEDs 31 which are disposed in the vicinity of the endmost portion LEDs 32 passes through the inclined edge faces 513 and 523, which are the abutting faces of the first and second light guide plates 51 and 52. However, the light reflected from the reflective sheets 53 is totally reflected by the inclined edge faces 523 of the second light guide plates 52. Therefore, the charge elimination light which is incident on the second light guide plates 52 from the central portion LEDs 31 does not return again to the first light guide plate 51, but rather is emitted from the left-hand edge faces 522 of the second light guide plate 52 toward the end portions of the photosensitive drum 121.

On the other hand, the charge elimination light emitted from the endmost portion LEDs 32, even if directed toward the uppermost portion of the reflective sheet 53, where the conditions are most severe in relation to total reflection, is reflected by the reflective sheet 53 and then totally reflected by the inclined edge face 523. The angle of inclination of the inclined edge faces 523 with respect to the LED substrate 40 is set in such a manner that total reflection of this kind is achieved. Consequently, the charge elimination light emitted from the endmost portion LEDs 32 is not transmitted by the inclined edge faces 523 and does not enter into the first light guide plate 51, but rather all of the charge elimination light from the endmost portion LEDs 32 passes through the left-hand edge surface 522 and is irradiated toward the circumferential surface of the end portions of the photosensitive drum 121. Therefore, on the circumference surface in the respective end portions of the photosensitive drum 121, the amount of light does not decline as in the prior art indicated by the dotted lines, but rather it is possible to ensure a similar amount of charge elimination light to the central portion, as indicated by the solid waveform line.

Figure 7A:
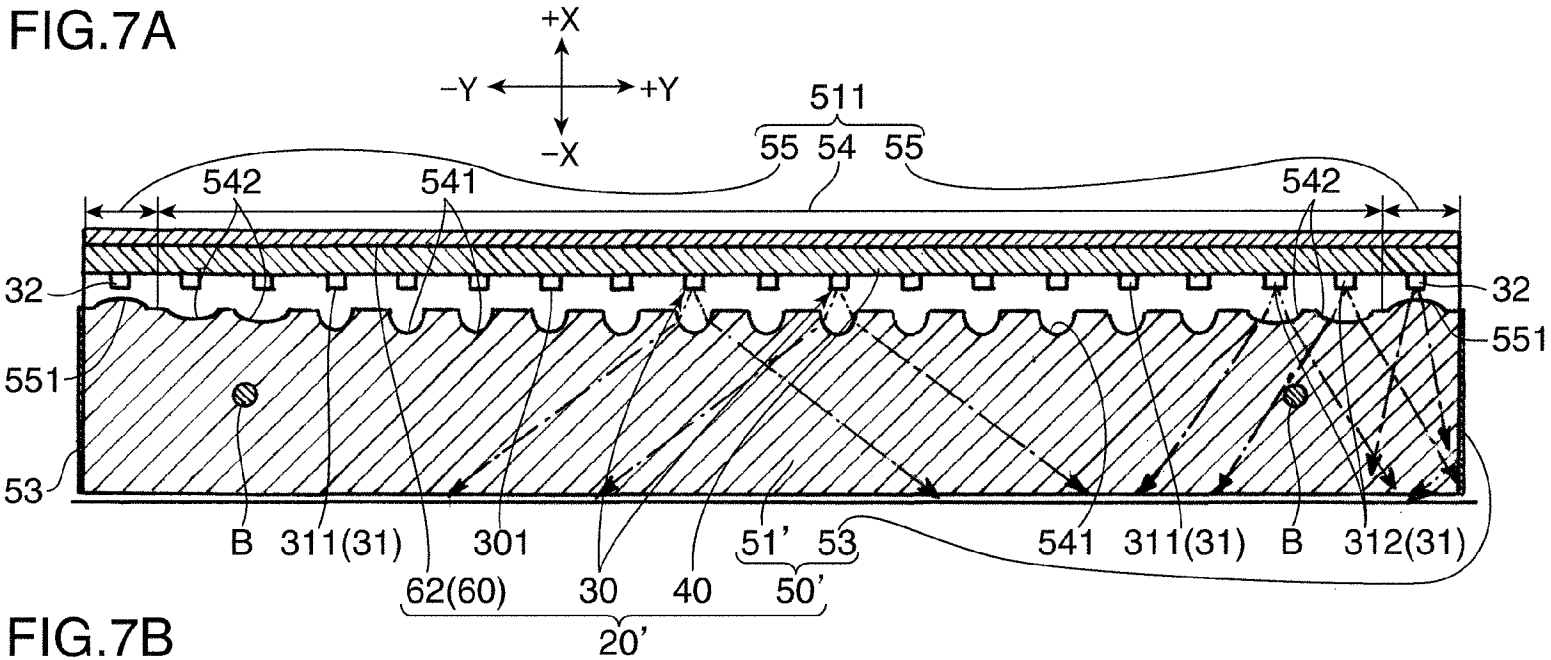
FIG. 7A is a cross-sectional diagram showing a charge eliminator in which a light guide plate according to the second embodiment is employed.
Figure 7B:
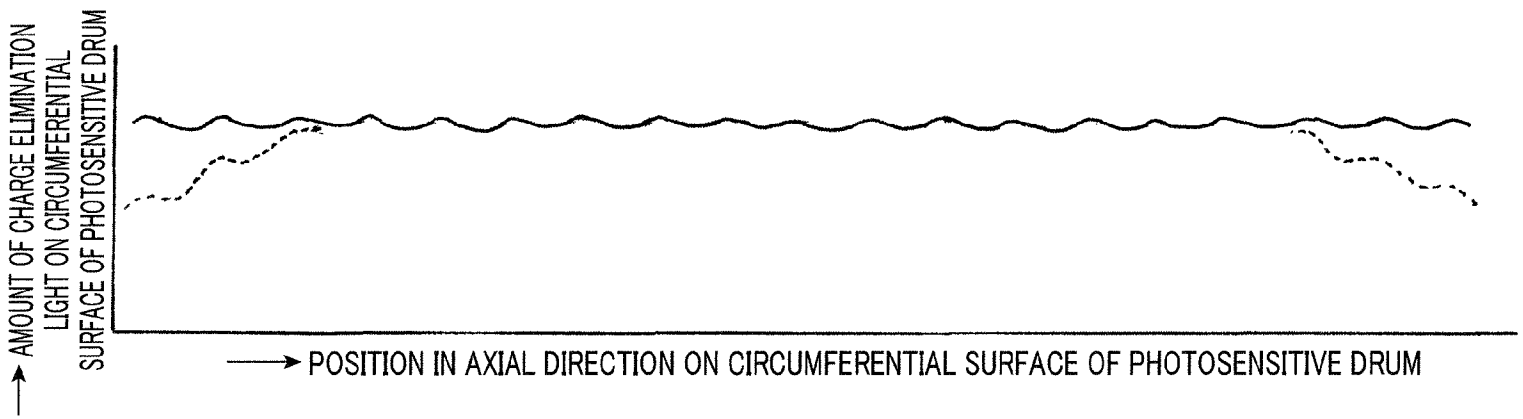
FIG. 7B is a graph showing the distribution of the amount of charge elimination light in this composition.

Next, a charge eliminator 20' which employs a light guide member 50' relating to the second embodiment is described on the basis of FIGS. 7A and 7B with reference to other drawings where necessary. FIG. 7A is a cross-sectional diagram showing a charge eliminator 20' employing the light guide member 50' as observed from the same viewpoint as FIG. 6A. The X and Y directions indicated in FIG. 7A are the same as those in FIG. 6A (−X: leftward; +X: rightward; −Y: forward; +Y: rearward).

The light guide member 50 according to the second embodiment includes a single light guide plate 51' and reflective sheets 53 which are attached to the front and rear end faces of this light guide plate 51'. A central incident edge portion (first incidence face) 54 is formed in the right-hand edge face 511 of the light guide plate 51' by the portion corresponding to the plurality of central portion LEDs 31 apart from both ends (in the example shown in FIG. 7A, there are 17 central portion LEDs), and furthermore respective end incident edge portions (second incidence faces) 55 are formed respectively by the portions corresponding to the one endmost portion LED 32 at either end.

Small-diameter concave faces 541 having a semicircular shape in plan view are provided in the central incident edge portion 54 respectively at positions opposing a plurality of central region LEDs 311 of the group of central portion LEDs 31 excluding the end portions of this group (in the example shown in FIG. 7, there are 13 central region LEDs 311). Furthermore, large-diameter concave faces 542 having a larger radius of curvature than the small-diameter concave faces 541 are formed respectively in either end of the central incident edge portion 54 so as to correspond to the end region LEDs 312 of the group of central portion LEDs 31 (the two LEDs situated at either end). The small-diameter concave faces 541 and the large-diameter concave faces 542 act as concave lenses which respectively diffuse the light. By providing the large-diameter concave faces 542 in the vicinity of the end portion incident edge portion 55, it is possible to prevent excessive diffusion of the charge elimination light.

Furthermore, protruding faces 551 having a circular arc shape in plan view are formed respectively, one each, on the respective end incident edge portions 55. These protruding faces 551 are provided so as to correspond to the endmost portion LEDs 32.

The remaining composition of the charge eliminator 20' having a light guide member 50' composed in this manner is similar to the charge eliminator 20 according to the first embodiment.

According to the light guide member 50' of the second embodiment, the charge elimination light emitted from the central region LEDs 311 in the central incident edge portion 54 receives the effect of the small-diameter concave faces 541 which act as concave lenses. For this reason, the charge elimination light is transmitted inside the light guide plate 51' while progressively broadening in the direction of travel and is emitted from the left-hand edge face 512, and therefore the light from the plurality of central portion LEDs 311 is mutually overlapping. By this means, charge elimination light is irradiated onto the circumferential surface of the photosensitive drum 121 in a uniform state of extremely little variation.

Furthermore, the charge elimination light emitted from the end region LEDs 312 receives the effects of the large-diameter concave faces 542 which act as concave lenses, and therefore is transmitted inside the light guide plate 51' while progressively broadening in the direction of travel, but this light is not diffused so as to reach the small-diameter concave faces 541. For this reason, the charge elimination light is irradiated effectively onto the end portions of the circumferential surface of the photosensitive drum 121.

Moreover, the charge elimination light emitted from the endmost LEDs 32 is transmitted inside the light guide plate 51' without broadening, due to the convex lens effect of the protruding faces 551, and is irradiated onto the circumferential surface of the end portions of the photosensitive drum 121 without any decline in the amount of light. By this means the amount of charge elimination light on the circumferential surface of the photosensitive drum 121 assumes a uniform state showing little variation throughout the whole length in the axial direction, as shown in FIG. 7B. Consequently, on the circumferential surface in the respective end portions of the photosensitive drum 121, the amount of light does not decline as in the prior art indicated by the dotted lines, but rather it is possible to ensure a similar amount of charge elimination light to the central portion, as indicated by the solid waveform line.

Figure 8A:
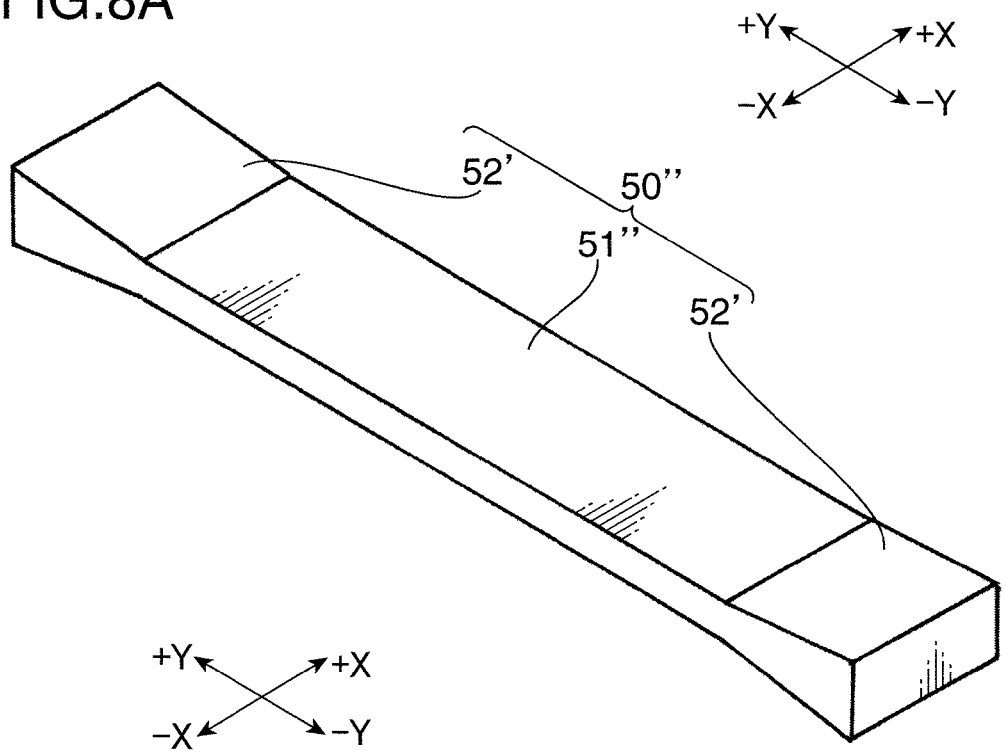
FIGS. 8A and 8B are perspective diagrams showing a light guide member relating to a third embodiment.
Figure 8B:
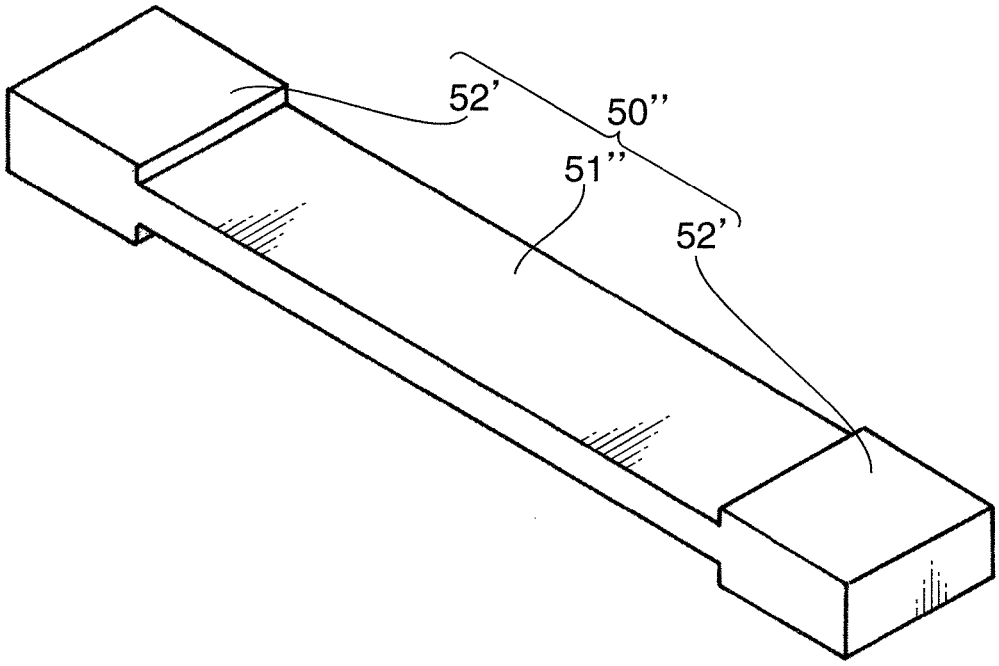

Next, the light guide member 50" relating to a third embodiment will be described on the basis of FIGS. 8A and 8B. FIGS. 8A and 8B are perspective diagrams showing a light guide member 50" relating to a third embodiment; FIG. 8A and FIG. 8B respectively show a first example and a second example of a light guide member 50" according to the third embodiment. The X and Y directions indicated in FIGS. 8A and 8B are the same as those in FIG. 4 (−X: leftward; +X: rightward; Y: forward; +Y: rearward).

The light guide member 50" according to the third embodiment is the same as the light guide plate 51' of the light guide member 50' according to the second embodiment in respect of being formed entirely as a single body from the same material, but the small-diameter concave faces 541, large-diameter concave faces 542 and protruding faces 551 formed in the right-hand edge face 511 according to the second embodiment (FIG. 7A) are not formed in the third embodiment.

A front and rear pair of second light guide plates 52' are provided in an integrated fashion extending respectively outwards from the front and rear end portions of the first light guide plate 51" of the light guide member 50". The vertical thickness dimension of the second light guide plate 52' is set to a broader width than the first light guide plate 51".

In the light guide member 50" according to the first example (FIG. 8A), the second light guide plates 52' are each set to a trapezoid shape in side view observed in the −X direction, in such a manner that the vertical thickness dimension gradually increases in the front/rear direction, respectively from the front and rear end portions of the first light guide plate 51. As opposed to this, in the light guide member 50" according to the second example (FIG. 8B), the respective second light guide plates 52' are both set to have a rectangular parallelepiped shape.

According to a light guide member 50" relating to the third embodiment which is composed in this way, the second incidence faces of the second light guide plates 52' are set to have a broader width than the first incidence face of the first light guide member, whereby the amount of charge elimination light incident per unit length via the second incidence faces of the second light guide plates (second light guide portions) 52' is made greater than the amount of charge elimination light incident per unit length via the first incidence face of the first light guide plate (first light guide portion) 51". As a result of this, it is possible to eliminate decrease in the amount of light in the end portions of the image carrying body.

As stated previously, the image forming apparatus 10 relating to the respective embodiments described above includes: a photosensitive drum 121 having a circumferential surface on which a toner image is formed, the drum rotating about an axle; a charger 123 which charges the surface of the photosensitive drum 121 in order to form a toner image; and a charge eliminator 20 which removes charge from the surface of the photosensitive drum 121 after the toner image has been transferred from the photosensitive drum 121 to a transfer material.

The charge eliminator 20 includes: a plurality of LEDs 30 forming light sources for generating charge elimination light, which are arranged in the axial direction of the photosensitive drum 121; and a light guide member 50, disposed between the LEDs 30 and the circumferential surface of the photosensitive drum 121, which guides charge elimination light onto the circumferential surface.

The light guide member 50 includes: a first light guide portion which guides charge elimination light to the intermediate portion of the photosensitive drum 121 in the axial direction (in the first embodiment, the first light guide portion is the first light guide plate 51 (see FIG. 6A), in the second embodiment, the portion of the light guide plate 51' inside which charge elimination light incident from the end portion incident edge faces 55 is not guided (see FIG. 7A), and in the third embodiment, the light guide plate 51" (see FIGS. 8A and 8B)); and second light guide portions which guide charge elimination light respectively onto both end portions of the photosensitive drum 121 in the axial direction (in the first embodiment, the second light guide portions are the second light guide plates 52, in the second embodiment, the portions of the light guide plate 51' inside which charge elimination light incident from the end portion incident edge surfaces 55 is guided, and in the third embodiment, the second light guide plates 52').

The plurality of LEDs 30 include central portion LEDs 31 which irradiate light onto the first light guide portion and endmost portion LEDs 32 which irradiate light onto the second light guide portions. The second light guide portions have a restrictive structure which allows the charge elimination light generated from the central portion LEDs 31, which is incident on the first light guide portion, to travel into the second light guide portion, while preventing the charge elimination light from the endmost portion LEDs 32, which is incident on the second light guide portion, from traveling into the first light guide portion and thus restricting external leaking of this light (the restrictive structure is not described in the third embodiment).

According to a composition of this kind, due to the action of the restrictive structure, both charge elimination light from the central portion LEDs 31 and charge elimination light from the endmost portion LEDs 32 is irradiated onto both end portions of the photosensitive drum 121, and consequently it is possible to eliminate decline in the amount of charge elimination light in both end portions of the photosensitive drum 121. Therefore, it is not necessary to arrange a greater number of LEDs 30 in the end portions of the photosensitive drum 121, or to increase the overall number of LEDs 30, or to make the actual charge eliminator 20 itself longer than the photosensitive drum 121. Moreover, neither is it necessary to increase the irradiation time of the charge elimination light in the end portions in the axial direction of the photosensitive drum 121, or to make the charge elimination range on the surface of the drum broader than the central portion, and furthermore, it is possible to prevent external leaking of charge elimination light in the end portions in the axial direction and consequently to eliminate decline in the amount of charge elimination light in both end portions in the axial direction.

In the light guide member 50 according to the first embodiment, a member constituting the second light guide portion as the restrictive structure is chosen such that a refractive index of the second light guide portion is greater than a refractive index of the first light guide portion, so as to create a restrictive structure. Therefore, due to the difference between the refractive indices of the first and second light guide portions, it is possible for the charge elimination light to travel from the first light guide portion into the second light guide portion, but the charge elimination light is prevented from traveling in the opposite direction. According to the first embodiment, it is possible to eliminate decline in the amount of light at either end portion of the photosensitive drum 121 by means of a simple method of using different materials for the first and second light guide members, looking in particular at their refractive indices.

Furthermore, in the light guide member 50' according to the second embodiment, the second light guide portion has end incident edge portions 55 where charge elimination light is incident from the endmost portion LEDs 32, and the restrictive structure is constituted by protruding faces 551 forming convex lenses where the end incident edge portions 55 protrude in a convex shape. The light from the endmost portion LEDs 32 is prevented from diffusing by the action of the convex lenses due to passing through the protruding surfaces 551 of the end incident edge portions 55, and the charge elimination light can be irradiated in a concentrated fashion onto the end portions of the photosensitive drum 121. Therefore, it is possible to eliminate decline in the amount of light at the end portions of the photosensitive drum 121.

Moreover, in the light guide member 50" according to the third embodiment, the second light guide plates 52' have second incidence faces where light from the endmost portion LEDs 32 is incident, and the second incidence faces have a greater width than the first incidence face of the first light guide plate 51". Therefore, it is possible to make the amount of light incident per unit length on the second light guide plates 52' via the second incidence faces greater than the amount of light incident per unit length on the first light guide member 51" via the first incidence face. Therefore, it is possible to eliminate decline in the amount of light at the end portions of the photosensitive drum 121.

The present invention is not limited to the embodiments described above and may also encompass the following contents.

(1) In the embodiments described above, a composite machine was given as an example of an image forming apparatus 10 comprising a charge eliminator 20. The image forming apparatus may also be a single-function machine which has the functions of any one of a copying machine, a printer or a facsimile machine.

(2) In the embodiments described above, a monochrome printing machine was given as an example of an image forming apparatus 10 including a charge eliminator 20. It is also possible to use a color printing machine instead of a monochrome printing machine.

(3) In the embodiments described above, the charge eliminator 20 is provided between the cleaning apparatus 125 and the charger 123. Instead of this, it is also possible to provide the charge eliminator 20 between the transfer roller 126 and the cleaning apparatus 125.

The concrete embodiments described above principally comprise inventions having the compositions described below.

The image forming apparatus relating to one aspect of the present invention is an image forming apparatus including: an image carrying body which has a surface on which a toner image is formed, and rotates about an axis; a charger which charges the surface of the image carrying body in order to form the toner image; and a charge eliminator which removes charge from the surface of the image carrying body after the toner image is transferred from the image carrying body to a transfer material; wherein the charge eliminator includes: a plurality of light sources which are arranged in an axial direction of the image carrying body, and generate charge elimination light; and a light guide member which is disposed between the plurality of light sources and the surface, and guides the charge elimination light onto the surface; the light guide member has a first light guide portion which guides the charge elimination light onto a central portion of the image carrying body in the axial direction, and a second light guide portion which guides the charge elimination light respectively onto both end portions of the image carrying body in the axial direction; the plurality of light sources include a first light source which irradiates light onto the first light guide portion and a second light source which irradiates light onto the second light guide portions; and the second light guide portion has a restrictive structure which allows charge elimination light from the first light source that is incident on the first light guide portion to travel into the second light guide portion, but restricts charge elimination light from the second light source that is incident on the second light guide portion from traveling into the first light guide portion.

According to this composition, due to the restrictive structure, the charge elimination light of the first light source which is incident on the first light guide portion is allowed to travel into the second light guide portion, but the charge elimination light of the second light source which is incident on the second light guide portion is restricted from traveling into the first light guide portion. Therefore, in either end portion of the image carrying body, both charge elimination light from the first light source and charge elimination light from the second light source are irradiated, and consequently, decline in the amount of charge elimination light in both end portions of the image carrying body is eliminated.

Desirably, in the composition described above, the second light guide portion has an outer side end face which faces outwards in the axial direction; and the restrictive structure also restricts charge elimination light of the second light source from leaking externally from the outer side end face.

If the light guide member has an outer side end face in an end portion in the axial direction, then charge elimination light may leak to the exterior of the image carrying body from the outer side end face. In a conventional image forming apparatus, leaking of the charge elimination light of this kind is not taken into consideration, which results in the occurrence of wasted charge elimination light which leaks externally from the end portion of the axial direction of the photosensitive drum (image carrying body) and is not irradiated onto the photosensitive drum. However, according to the composition described above, as a result of the restrictive structure suppressing leakage of charge elimination light, it is possible to irradiate charge elimination light uniformly, without waste, onto the surface of the image carrying body.

In the composition described above, desirably, a member constituting the second light guide portion so as to form the restrictive structure is chosen such that a refractive index of the second light guide portion is greater than a refractive index of the first light guide portion.

According to this composition, due to the difference between the refractive indices of the first and second light guide portions, it is possible for the charge elimination light to travel from the first light guide portion into the second light guide portion, but the charge elimination light is prevented from traveling in the opposite direction. In this way, it is possible to eliminate decline in the amount of light at either end portion of the image carrying body by means of the simple method of using different materials for the first and second light guide portions, with particular attention paid to the refractive indices, which is very beneficial in terms of costs.

In this case, desirably, the second light guide portion has an incidence face on which charge elimination light from the second light source is incident, an emission face from which charge elimination light is emitted, and a boundary face with the first light guide portion; and the boundary face is inclined at an angle such that the charge elimination light traveling toward the first light guide portion is reflected totally.

By means of this composition, even when the charge elimination light in the second light guide portion arrives at the boundary face, the light is reflected totally by the boundary face and is prevented from traveling into the first light guide portion. Consequently, the light which is prevented from traveling into the first light guide portion is irradiated onto the end portions of the image carrying body from the second light guide portion, and therefore contributes yet further to eliminating decline in the amount of light in both end portions of the image carrying body.

Furthermore, desirably, a length of the emission face in the axial direction is set to be longer than a length of the incidence face in the axial direction. By means of this composition, the ratio of the charge elimination light incident on the second light guide portion via the incidence face which is directed toward the emission face becomes greater, and consequently it is possible to increase the amount of light directed onto the image carrying body.

Moreover, desirably, a reflective material is attached to the outer side end face. According to this composition, the charge elimination light which travels in the second light guide portion and is directed toward the outer side end face in the axial direction of the second light guide portion is reflected by the reflective material and is returned inside the second light guide portion, thereby compensating for decline in the amount of light in the end portion of the image carrying body.

In the composition described above, it is possible to adopt a mode where the second light guide portion has a second incidence face on which charge elimination light from the second light source is incident; and the restrictive structure is constituted by the second incidence face protruding in a convex shape. According to this composition, the light from the second light source is prevented from being diffused by passing through the second incidence face, and is irradiated in a concentrated fashion onto the end portion of the image carrying body. Consequently, decline in the amount of light in the end portions of the image carrying body is eliminated.

In this case, desirably, the first light guide portion has a first incidence face on which charge elimination light from the first light source is incident; and a plurality of concave faces arranged in the axial direction are formed in the first incidence face.

According to this composition, the first incidence face which is set as the incidence face of the first light guide portion is formed with concave faces and thereby provided with the action of concave lenses, whereby the light from the first light source is diffused by passing through the first incidence face and charge elimination light is irradiated throughout a broad range in the central portion of the image carrying body. Consequently, the amount of light in the central portion of the image carrying body is made uniform.

Furthermore, it is also possible to adopt a composition wherein concave faces in the vicinity of the second light guide portion, of the plurality of concave faces, are set to have a greater radius of curvature than other concave faces. According to this composition, the light emitted from the first light source in the vicinity of the second light guide portion is not diffused into the central portion, and therefore the charge elimination light can be irradiated efficiently into the second light guide portion.

Desirably, in the composition described above, the first light guide portion has a first incidence face on which the charge elimination light from the first light source is incident; the second light guide portion has a second incidence face on which the charge elimination light from the second light source is incident; and an amount of incident charge elimination light per unit length via the second incidence face is greater than an amount of incident charge elimination light per unit length via the first incidence face.

According to this composition, in respect of both end portions of a light guide member where it is normally difficult to guarantee the required amount of light, the amount of charge elimination light per unit length incident via the second incident face corresponding to the respective end portions is made greater than the amount of charge elimination light per unit length incident via the centrally disposed first incidence face. Therefore, the conventional problem of a low amount of incident light is eliminated and consequently, decline in the amount of light in the both end portions of the image carrying body can be eliminated.

According to the image forming apparatus relating to the present invention which was described above, it is possible to eliminate decline in the amount of charge elimination light in both end portions of the image carrying body. Consequently, it is not necessary to increase the irradiation time of the charge elimination light in the end portions in the axial direction of the photosensitive drum, or to make the charge elimination light irradiation range on the surface of the drum broader than the central portion, as implemented in the prior art, and furthermore, it is possible to prevent external leaking of charge elimination light in the end portion in the axial direction and consequently to eliminate decline in the amount of charge elimination light in the end portions in the axial direction.

This application is based on Japanese Patent application serial Nos. 2009-169841 and 2009-263337 filed in Japan Patent Office on Jul. 21, 2009 and Nov. 18, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image carrying body which has a surface on which a toner image is formed, and rotates about an axis;

a charger which charges the surface of the image carrying body in order to form the toner image; and a charge eliminator which removes charge from the surface of the image carrying body after the toner image is transferred from the image carrying body to a transfer material;

wherein the charge eliminator includes:

a plurality of light sources which are arranged in an axial direction of the image carrying body, and generate charge elimination light; and a light guide member which is disposed between the plurality of light sources and the surface, and guides the charge elimination light onto the surface;

the light guide member has a first light guide portion which guides the charge elimination light onto a central portion of the image carrying body in the axial direction, and a second light guide portion which guides the charge elimination light respectively onto both end portions of the image carrying body in the axial direction;

the plurality of light sources include a first light source which irradiates light onto the first light guide portion and a second light source which irradiates light onto the second light guide portions; and the second light guide portion has a restrictive structure which allows charge elimination light from the first light source that is incident on the first light guide portion to travel into the second light guide portion, but restricts charge elimination light from the second light source that is incident on the second light guide portion from traveling into the first light guide portion.

2. The image forming apparatus according to claim 1, wherein the second light guide portion has an outer side end face which faces outwards in the axial direction; and the restrictive structure also restricts charge elimination light of the second light source from leaking externally from the outer side end face.

3. The image forming apparatus according to claim 2, wherein a member constituting the second light guide portion so as to form the restrictive structure is chosen such that a refractive index of the second light guide portion is greater than a refractive index of the first light guide portion.

4. The image forming apparatus according to claim 3, wherein the second light guide portion has an incidence face on which charge elimination light from the second light source is incident, an emission face from which the charge elimination light is emitted, and a boundary face with the first light guide portion; and the boundary face is inclined at an angle such that the charge elimination light traveling toward the first light guide portion is reflected totally.

5. The image forming apparatus according to claim 4, wherein a length of the emission face in the axial direction is set to be longer than a length of the incidence face in the axial direction.

6. The image forming apparatus according to claim 4, wherein a reflective material is attached to the outer side end face.

7. The image forming apparatus according to claim 1, wherein the second light guide portion has a second incidence face on which charge elimination light from the second light source is incident; and the restrictive structure is constituted by the second incidence face protruding in a convex shape.

8. The image forming apparatus according to claim 7, wherein the first light guide portion has a first incidence face on which charge elimination light from the first light source is incident; and a plurality of concave faces arranged in the axial direction are formed in the first incidence face.

9. The image forming apparatus according to claim 8, wherein concave faces in the vicinity of the second light guide portion, of the plurality of concave faces, are set to have a greater radius of curvature than other concave faces.

10. The image forming apparatus according to claim 1, wherein the first light guide portion has a first incidence face on which the charge elimination light from the first light source is incident;

the second light guide portion has a second incidence face on which the charge elimination light from the second light source is incident; and an amount of incident charge elimination light per unit length via the second incidence face is greater than an amount of incident charge elimination light per unit length via the first incidence face.

* * * * *